United States Patent [19]

Kuhasalo et al.

[11] Patent Number: 5,024,729

[45] Date of Patent: Jun. 18, 1991

[54] SUCTION ROLL WITH TURBULENCE SUPPRESSION ELEMENT

[75] Inventors: Antti Kuhasalo; Olavi Viitanen; Heikki Ilvespää, all of Jyväskylä, Finland

[73] Assignee: Valmet Paper Machinery Inc., Finland

[21] Appl. No.: 567,106

[22] Filed: Aug. 14, 1990

[30] Foreign Application Priority Data

Aug. 18, 1989 [FI] Finland ..... 893893

[51] Int. Cl.[5] ..... D21F 5/02

[52] U.S. Cl. ..... 162/372; 29/121.1; 34/117; 34/120; 162/368

[58] Field of Search ..... 162/368–372; 34/115, 117, 120; 29/121.1, 121.3, 121.5, 121.6; 226/95, 193; 210/406

[56] References Cited

U.S. PATENT DOCUMENTS

| | | | |
|---|---|---|---|
| 2,969,837 | 1/1961 | Reynar | 162/371 |
| 3,201,309 | 8/1965 | Stuebe | 162/368 |
| 3,827,855 | 8/1974 | Blake | 34/115 |
| 4,207,998 | 6/1980 | Schmid | 29/121.1 |
| 4,564,418 | 1/1986 | Blumle | 162/368 |
| 4,932,138 | 6/1990 | Liedes | 162/370 |

*Primary Examiner*—Karen M. Hastings

*Attorney, Agent, or Firm*—Steinberg & Raskin

[57] ABSTRACT

The invention relates to a suction roll (10) comprising a turbulence suppression element (16) located in the vicinity of the end of an external suction pipe (15). The turbulence suppression element (16) comprises at least one sheet member and is fitted relative to the end of the suction pipe (15) in such a way that turbulence in the intake air during the suction phase is substantially prevented and that a low air pressure is thus maintained at a desired, approximately constant value on the inner surface of the roll shell along the entire roll width and the quantity of suction air is also maintained at a desired, approximately constant value through the perforated sections (14) of the roll shell.

6 Claims, 3 Drawing Sheets

10
11
14
14a
14b
C
R
E
L1
16
12a
15
13b
12b
13a
X
W
H
F
I

A0
A1

SUCTION ROLL WITH TURBULENCE SUPPRESSION ELEMENT

BACKGROUND OF THE INVENTION

The invention relates to a suction roll comprising a roll shell rotatable on journals and which roll shell comprises a cylinder having a plurality of perforated sections. Suction is directed to the internal space of the roll shell and air is sucked through the perforations to press the paper web toward the outer surface of the roll shell and which roll shell has an interior space which is maintained at a low air pressure by an external suction pipe, the interior of the suction roll having no suction box or corresponding device arrangement, the result of which is that suction is directed only to holding the paper web on the outer surface of the roll shell.

An earlier patent application FI 881106 (equivalent U.S. Ser. No. 07/320,985, filed Mar. 9, 1989, applicant describes a suction roll construction in which the paper web is pressed toward a lower drying cylinder. The application is based on the idea of the paper web being supported by a suction roll which does not comprise a suction box inside the roll. In accordance with the above-mentioned invention, the suction roll construction has been formed in such a way that the suction roll comprises a cylinder having perforations, and a separate recess, preferably a groove, through which low air pressure is distributed over a larger area on the roll surface for achieving a suitable suction force on the paper web. By dimensioning the holes appropriately in accordance with this application, a sufficient force to hold the web to the roll surface can be achieved without having to place a suction box or another corresponding arrangement inside the suction roll.

SUMMARY OF THE INVENTION

An object of the present invention is to improve the above-mentioned suction roll construction. When air is removed from a rotating cylinder with a perforated shell and a hollow interior via an external hollow shaft or an external suction pipe, turbulence is created inside the cylinder, which causes high air resistance and thus makes the removal of air from the cylinder more difficult. This detrimental turbulence is caused by an angular-momentum effect.

This turbulence produces a suction air flow loss, which is dependent on the rotational speed of the cylinder. In practice, this means that the higher the circumferential speed of the suction roll is, the less the roll's suction device is able to remove air from the interior of the roll, whereby the air flow through the perforated roll shell becomes inadequate.

An object of the invention is, therefore, to provide a suction roll without an internal suction box or the like, wherein the occurrence of such turbulence within the suction roll or cylinder is prevented.

An object of the invention is thus a suction roll construction, by means of which a large quantity of air can be removed efficiently through perforated sections of the suction roll without the occurrence of detrimental turbulence in the roll and the resultant suction air flow loss.

The invention comprises an apparatus in which a sheet member for preventing air turbulence which rotates with the roll has been formed inside the roll in the vicinity of an external, directly-connected suction device. This sheet member is disposed in such a way that the air flowing along the inner surface of the cylinder substantially perpendicularly contacts an edge or planar surface of the turbulence suppression element. The occurrence of detrimental turbulence can thus be efficiently prevented by using such a turbulence suppression element.

The suction roll in accordance with the invention comprises a turbulence suppression element located in the vicinity of the end of an external suction device connected directly to the suction roll, the element comprising at least one sheet member, whose surface extends substantially perpendicularly to the longitudinal axis of the roll and which turbulence suppression element is fitted relative to the end of the suction pipe in such a way that turbulence in the intake air during suction operation is substantially prevented and that a low air pressure is thus maintained at a desired, approximately constant value on the inner surface of the roll shell along the entire roll width and the quantity of suction air flow is also maintained at a desired, approximately constant value through the perforations of the roll shell.

BRIEF DESCRIPTION OF THE DRAWINGS

The invention will next be described with reference with certain preferred embodiments of the invention, which are shown in the figures of the enclosed drawings but to which the invention is not intended to be limited.

DESCRIPTION OF THE PREFERRED EMBODIMENTS

Figures 1A, 1B, 1C:
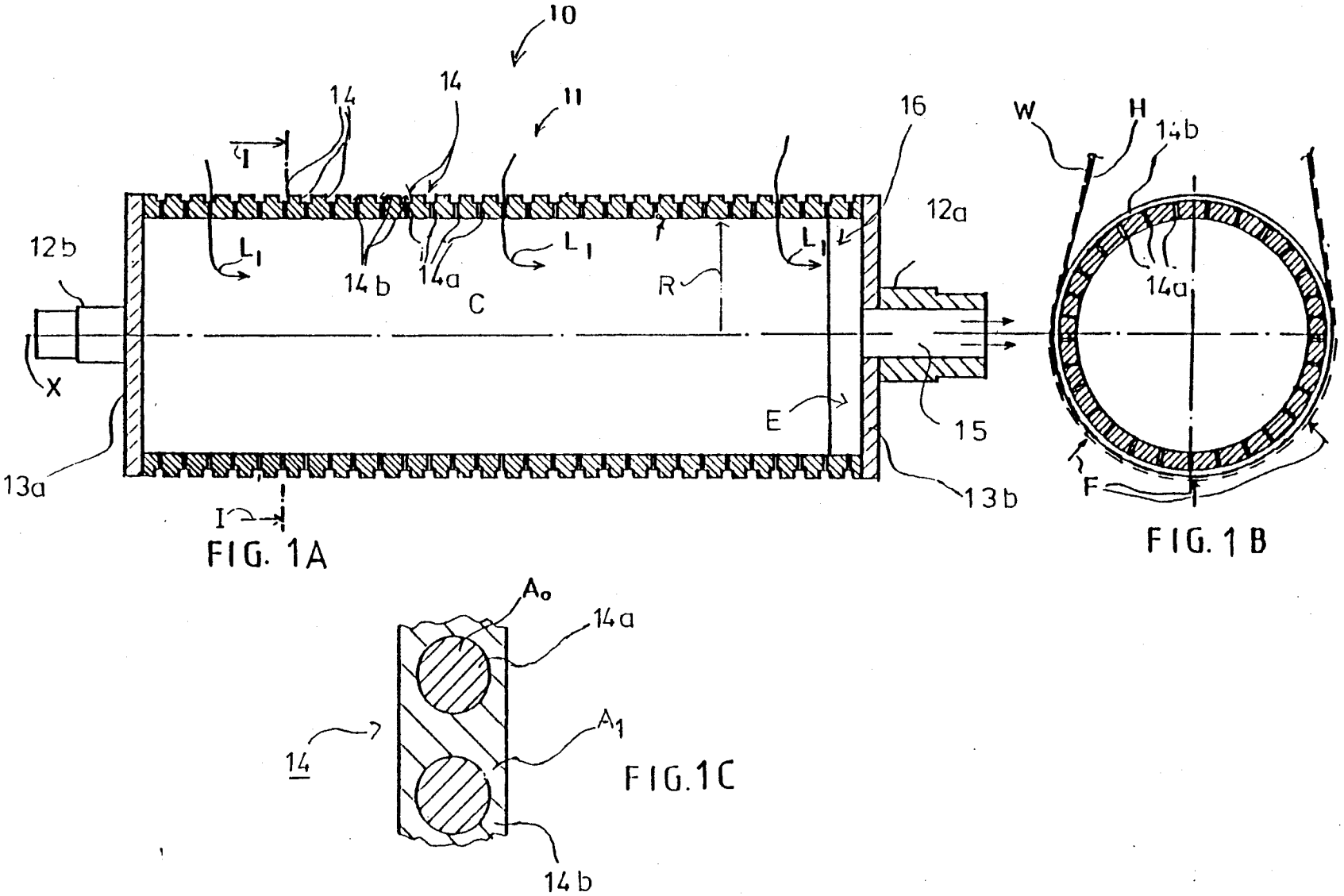
FIG. 1A is a cross-sectional view of the suction roll according to the invention.
FIG. 1B is a sectional view looking in the direction of lines I—I of FIG. 1A.
FIG. 1C illustrates the cross-sectional flow areas of the roll grooving and perforation and their relationship to each other.

FIG. 1A shows a suction roll 10 according to the invention. The suction roll 10 comprises a roll shell 11. The roll shell 11 is mounted to rotate on journals 12*a* and 12*b*, which are connected to the roll shell 11 via end flanges 13*a* and 13*b*. The roll shell 11 comprises a cylinder having a plurality of perforated sections 14. Holes 14*a* are formed in the roll shell 11. Each perforated section 14 comprises a section with a plurality of holes 14*a* and a groove or recess 14*b* to which the hole section is connected. Air is sucked (arrow $L_1$) through the holes 14*a* of the roll shell 11 to the interior C of the suction roll 10, and the paper web W can be pressed against the felt H by means of low air pressure within the suction roll 10 and through it against the outer surface of the roll shell 11. A suction pipe 15 is connected to the journal 12*a*, and the journal 12*a* is preferably a hollow shaft, or another structural element through which air can be sucked. The pressing of the web against the felt H is thus achieved without the suction roll 10 containing a suction box or other suction producing element. Each perforated section 14 is dimensioned so that the air flow through the perforated cylinder remains within controlled limits at all points on the roll shell surface. The suction roll 10 of FIG. 1 comprises an inventive turbulence suppression element 16, preferably a sheet member rotating with the roll 10 and affixed thereto. The turbulence suppression apparatus 16 is located in the vicinity of the suction pipe 15 and comprises a plate having a surface (E).

FIG. 1B shows a sectional view of FIG. 1A along the lines I—I. The Figure further includes a drying fabric or felt H and a paper web W. By means of the suction air $L_1$ is achieved a force F that keeps the web W on the felt H and the roll 10.

FIG. 1C illustrates the cross-sectional hole area $A_0$ of the holes 14*a* and the cross-sectional flow area $A_1$ of the recess 14*b* for each perforated section 14. The ratio of the total cross-sectional flow area ($A_0$) of the holes of the suction roll 10 to the total cross-sectional flow area ($A_1$) of the recesses is within the range of 1:10 to 1:150 and most preferably within the range of 1:50 to 1:110.

The cylinder or the roll 10 comprises a plurality of perforated sections 14 such that the air flow Q through the holes 14*a* to the interior C of the cylinder 10 is within the range of 500 to 1500 cubic meters per hour.

Figure 2:
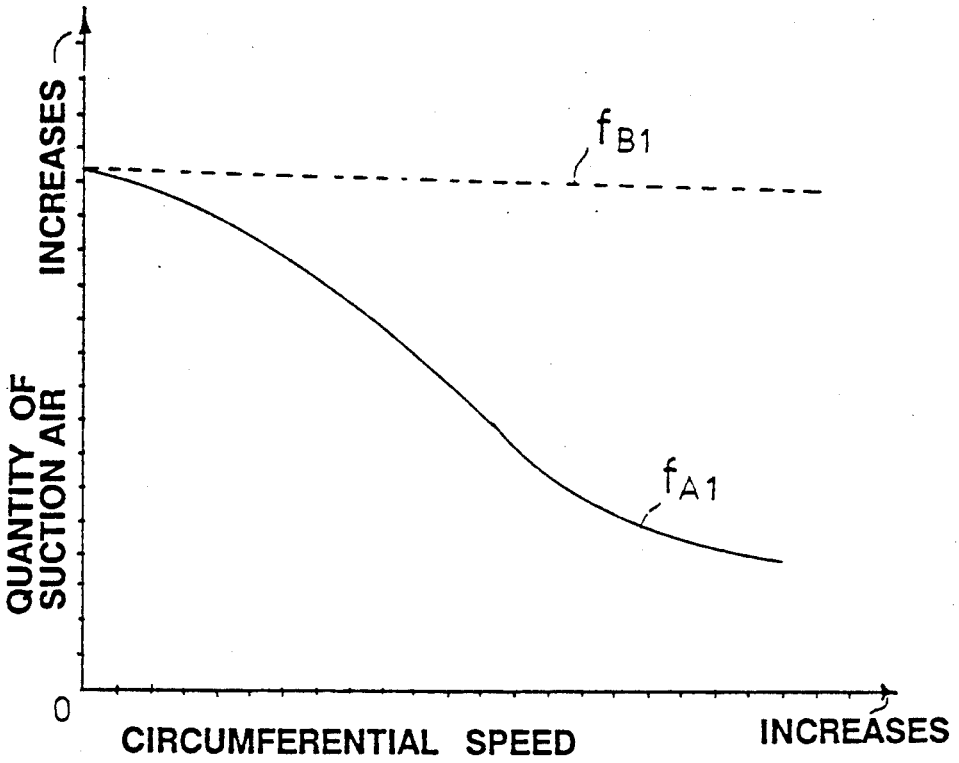
FIG. 2 is a graph showing the quantity of suction air as a function of the circumferential speed. The curve $f_{A1}$ is for a suction roll comprising no turbulence suppression element and the curve $f_{B1}$ shows a suction roll with the inventive turbulence suppression element.

FIG. 2 shows the quantity of suction air flow through the perforated sections 14 as a function of the circumferential speed. The curve $f_{A1}$ represents a suction roll construction with no inventive turbulence suppression element 16. FIG. 2 shows that, when the circumferential speed increases, the quantity of suction air considerably decreases. FIG. 2 shows a corresponding curve $f_{B2}$ with an inventive turbulence suppression element 16. It can be seen from curve $f_{B2}$ that, when the circumferential speed increases, the quantity of suction air remains approximately constant, which is an object of the invention.

Figure 3:
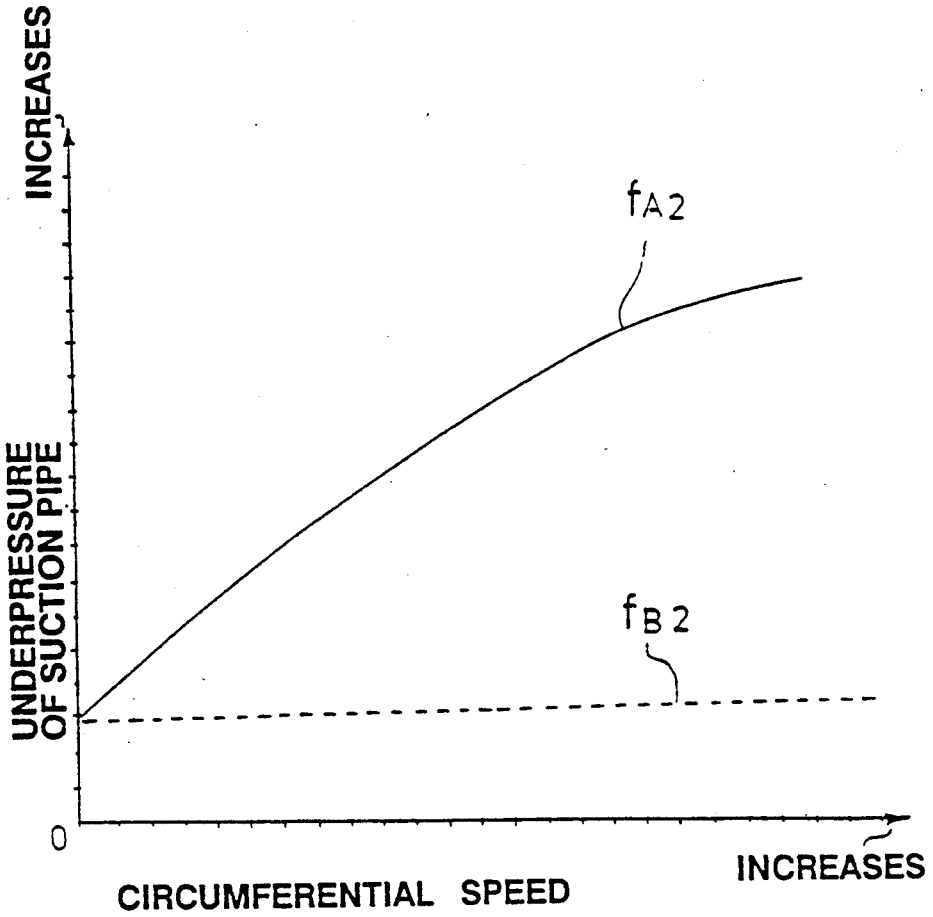
FIG. 3 is a graph showing the underpressure (low air pressure) of the suction pipe as a function of the circumferential speed. The curve $f_{A2}$ corresponds to a suction roll having no turbulence suppression element and the curve $f_{B2}$ corresponds to a suction roll with a turbulence suppression element.

FIG. 3 shows the underpressure (low air pressure) of the suction pipe 15 as a function of the circumferential speed of the roll 10. The curve $f_{A2}$ represents an apparatus with no turbulence suppression. The Figure shows that, as the circumferential speed increases, the underpressure of the suction pipe considerably increases at the same time. If an inventive turbulence suppression element 16 corresponding to the curve $f_{B2}$ is utilized, the underpressure of the suction pipe 15 remains approximately constant as a function of the circumferential speed.

Figure 4A:
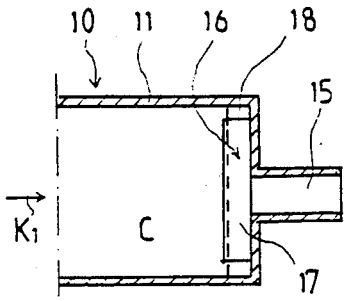
FIG. 4A shows a sectional elevational view of a first preferred embodiment of the inventive turbulence suppression element.
Figure 4B:
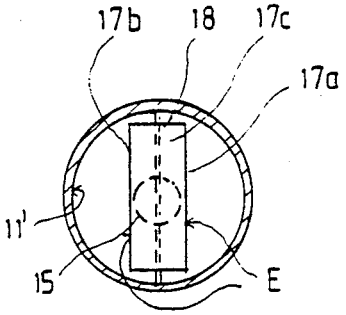
FIG. 4B shows the construction of FIG. 4A seen from the direction of the arrow $K_1$ of FIG. 4A.
Figure 4C:
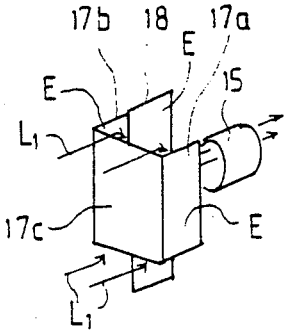
FIG. 4C shows an axonometric view of the embodiment of FIG. 4A.

FIGS. 4A–4C show a first preferred embodiment of the inventive turbulence suppression apparatus. In accordance with FIGS. 4A–4C, the turbulence suppression element 16 comprises sheet members 17*a* and 17*b*, which are disposed to be approximately parallel to the longitudinal direction of the roll and connected to each other by a sheet member 17*c*. The cross-sectional profile of the construction is thus a U-shaped profile. The entire construction is fastened to the roll 11 by means of a sheet member 18. The profile formed by the sheet members 17*a*, 17*b*, 17*c* is open at its ends, and an air flow in accordance with the arrow $L_1$ is thus facilitated from the ends of the U-shaped element onto its inner surface and further via the suction pipe 15 out of the interior C of the roll 10.

FIG. 4C shows axonometrically the turbulence suppression element of FIGS. 4A and 4B, and the arrow $L_1$ indicates the passage of the air flow.

Figure 5A:
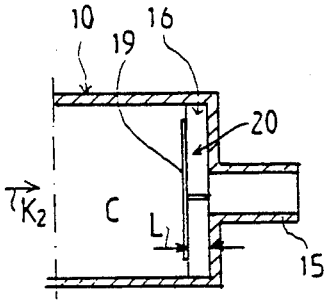
FIG. 5A shows a sectional elevational view of a second preferred embodiment of the inventive turbulence suppression element.
Figure 5B:
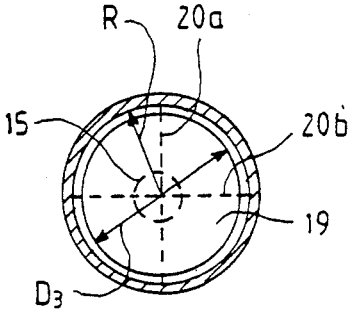
FIG. 5B is a view of the embodiment of FIG. 5A seen from the direction of the arrow $K_2$.
Figure 5C:
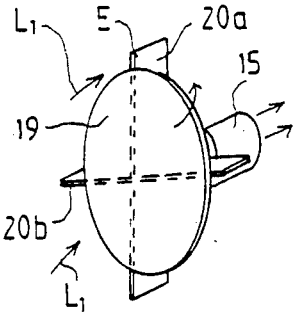
FIG. 5C shows an axonometric view of the embodiment of FIG. 5A.

FIGS. 5A–5C show a second preferred embodiment of the inventive turbulence suppression element. The element comprises a turbulence suppression element 16 formed of a circular sheet member 19, which is fastened to the roll by means of at least one sheet member 20. FIGS. 5A–5C show a construction in which the circular sheet member 19 is fastened by means of two sheet members 20*a* and 20*b* to the end of the roll shell 11. As shown in FIG. 5C, the dimensions of the circular sheet member 19 are such that a sufficient flow gap remains between the circular sheet member and the inner surface 11' of the roll shell, via which gap the air flow can further pass to the suction pipe 15. In the Figure, $D_3$ refers to the diameter of the circular plate. $D_3$ is approximately $0.9\times$ the interior diameter $D_1$ of the roll shell 11. The width L of the fastening plates 20*a*, 20*b* is approximately $0.5\times$ the diameter $D_2$ of suction pipe 15.

Figure 6A:
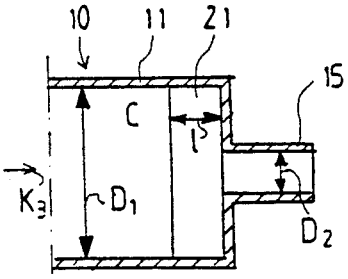
FIG. 6A shows a sectional view of a third preferred embodiment of the inventive turbulence suppression element.
Figure 6B:
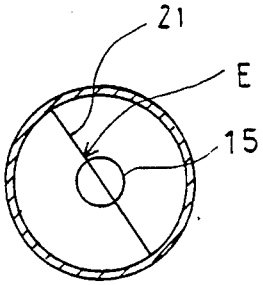
FIG. 6B is a view of the embodiment of FIG. 6A seen from the direction of the arrow $K_3$.
Figure 6C:
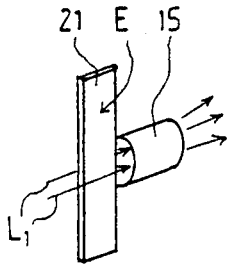
FIG. 6C shows an axonometric view of the embodiment of FIG. 6A.

FIGS. 6A–6C show the third preferred embodiment of the inventive turbulence suppression element 16. In the embodiment of the Figure, the turbulence suppression element 16 is formed only of a sheet member 21. The sheet member 21 is located in the immediate vicinity of the end of the suction pipe 15 and centered on the axis of rotation X of the suction roll 10. The sheet member 21 covers the entire diameter length $D_1$ of the suction roll 10. In the embodiment of the figure, the width 1 of the sheet member 21 is around $(1\text{–}1.5)\times D_2$ (suction pipe diameter).

FIG. 6C shows the turbulence-free passage of the air flow (arrow $L_1$) via the perforation sections 14 of the roll shell 11 to the suction pipe 15, as the sheet member 21 effectively prevents turbulence in the air flow.

What is claimed is:

1. A suction roll comprising:

a roll shell, said roll shell comprising a plurality of recesses, each recess having a plurality of holes therein through which holes air is sucked to press a paper web toward the outer surface of the roll shell;

a pair of journals about which said roll shell is rotatable;

said suction roll having an internal space within said roll shell with no suction box therein and in which suction roll a suction condition is created by an external suction device directly connected to one of said journals;

an air turbulence suppression element connected to an end of said roll shell which is in proximity to said one journal directly connected to said external suction device, said turbulence suppression element comprising at least one shell member whose surface extends perpendicularly to the longitudinal axis of the roll and which directs air flow within said roll shell so as to reduce air turbulence therein and thus maintain a substantially constant suction condition along the inner surface of said roll shell throughout its entire width and to maintain a substantially constant flow of suction air through said recesses of said roll shell, said suction roll and device being arranged so that said suction condition is applied over the entire inner surface of the roll shell.

2. The suction roll of claim 1, wherein said air turbulence suppression element comprises a rectangular sheet member having two opposite ends respectively connected to said inner surface of said roll shell and being oriented such that air flow through said suction roll in the direction of said external suction device is effectively bisected by an edge of said sheet member such that air turbulence within said roll shell is reduced.

3. The suction roll of claim 1, wherein said turbulence suppression element comprises two substantially parallel members and a third sheet member connecting said two sheet members such that said two sheet members and said third sheet member together have a substantially U-shaped cross section and are oriented such that air flowing through said suction roll in the direction of said external device flows around opposite, unconnected edges of said third sheet member and between said two substantially parallel sheet members such that air turbulence within said roll shell is reduced, and said turbulence suppression element further comprises a fourth sheet member connecting said third sheet member to said inner surface of said roll shell.

4. The suction roll of claim 1, wherein said turbulence suppression element comprises a rectangular sheet member having two opposite ends respectively connected to said inner surface of said roll shell and a circular sheet member connected to another end of said rectangular sheet member, said another end being the furthest end of said rectangular sheet member from said external suction device, and said circular sheet member having a smaller diameter than the inner diameter of said roll shell such that air flows around said circular sheet member towards said suction device, thus reducing air turbulence within said roll shell.

5. The suction roll of claim 1, wherein the ratio of the total cross-sectional area of the holes to the total cross-sectional area of the recesses is within the range of 1:10 to 1:150.

6. The suction roll of claim 5, wherein the ratio of the total cross-section area of the holes to the total cross-sectional area of the recesses is within the range of 1:50 to 1:110.

* * * * *